US007537124B2

(12) United States Patent
Chen

(10) Patent No.: US 7,537,124 B2
(45) **Date of Patent: *May 26, 2009**

(54) TOOL RACK WITH LOCKING DEVICE

(76) Inventor: Chang-Ying Chen, No. 5, Alley 320, Shi Hu Rd., Ta Li Hsiang, Taichung Hsien (TW)

( * ) Notice: Subject to any disclaimer, the term of this patent is extended or adjusted under 35 U.S.C. 154(b) by 292 days.

This patent is subject to a terminal disclaimer.

(21) Appl. No.: 11/305,242

(22) Filed: Dec. 19, 2005

(65) Prior Publication Data

US 2007/0141885 A1 Jun. 21, 2007

(51) Int. Cl.
*A47F 7/00* (2006.01)

(52) U.S. Cl. ..... 211/70.6

(58) Field of Classification Search ..... 211/70.6, 211/4, 60.1, 68; 206/349, 377
See application file for complete search history.

(56) References Cited

U.S. PATENT DOCUMENTS 2,119,217 A * 5/1938 Rocchi ..... 206/376
5,941,386 A * 8/1999 Hu et al. ..... 206/376
6,126,004 A * 10/2000 Ling ..... 206/377
6,202,864 B1 * 3/2001 Ernst et al. ..... 211/70.6
6,315,121 B1 * 11/2001 Hansen ..... 206/376
6,401,923 B1 * 6/2002 Huang ..... 206/376
7,178,670 B2 * 2/2007 Chen ..... 206/376
2006/0108300 A1 * 5/2006 Lin et al. ..... 211/70.6
2007/0210021 A1 * 9/2007 Whitehead et al. ..... 211/70.6

* cited by examiner

*Primary Examiner*—Sarah Purol

(57) ABSTRACT

A tool rack includes two fixed members and two movable members movably received in the fixed members. The two movable members are connected to and controlled by a locking device. Each fixed member has a plurality of a first protrusions and each first protrusion has an open top. Each movable member has a second protrusion and a third protrusions, both of which are movably engaged with the open tops of the first protrusions. Tools are clamped by the first and second protrusions when the locking device is in the locked position. The second protrusions are moved away from the first protrusion, and the third protrusions push the tool out from the recess when the locking device is in the unlock position.

7 Claims, 6 Drawing Sheets

TOOL RACK WITH LOCKING DEVICE

FIELD OF THE INVENTION

The present invention relates to a tool rack for positioning tools and includes a locking device which locks or releases the tools on the rack.

BACKGROUND OF THE INVENTION

A conventional tool rack for displaying or receiving tools generally includes a body with a plurality of recesses and the tools are engaged with the recesses. A latest tool rack known to applicant is made by way of blow molding and includes a plurality of recesses such that tools can be engaged with the recesses. In order to securely positioning the tools, the recesses are designed such that the tools have to be force-fitted into the recesses. However, when the users want to pick the tools off from the rack, it takes time and is inconvenient. Although some racks have access notch for insertion of the users' fingers to pick the tools, the peripheries of the recesses tend to be worn out after frequent use.

The present invention intends to provide a tool rack which has two fixed members and two movable members so as to clamp the tools in position, and the movable members are controlled by a locking device so that the tool rack can be used for longer period of time.

SUMMARY OF THE INVENTION

The present invention relates to a tool rack that comprises two fixed members and each fixed member has a plurality of a first protrusions and each first protrusion has an open top. An end member is connected to two respective ends of the fixed members so as to receive a locking device therein. Two movable members are movably received in the fixed members respectively and each movable member has a second protrusion and a third protrusions extending from a top thereof. A plurality of recesses are defined between the second protrusions and the third protrusions. The second protrusions and the third protrusions are movably engaged with the open tops of the first protrusions. The locking device has two inclined grooves defined in an underside thereof. Two blocks are respectively connected to two respective ends of the two movable members and are movably engaged with the two inclined grooves of the locking device. When the locking device moves, the two movable members moved in the fixed members to clamp the tools or unlock the tools.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
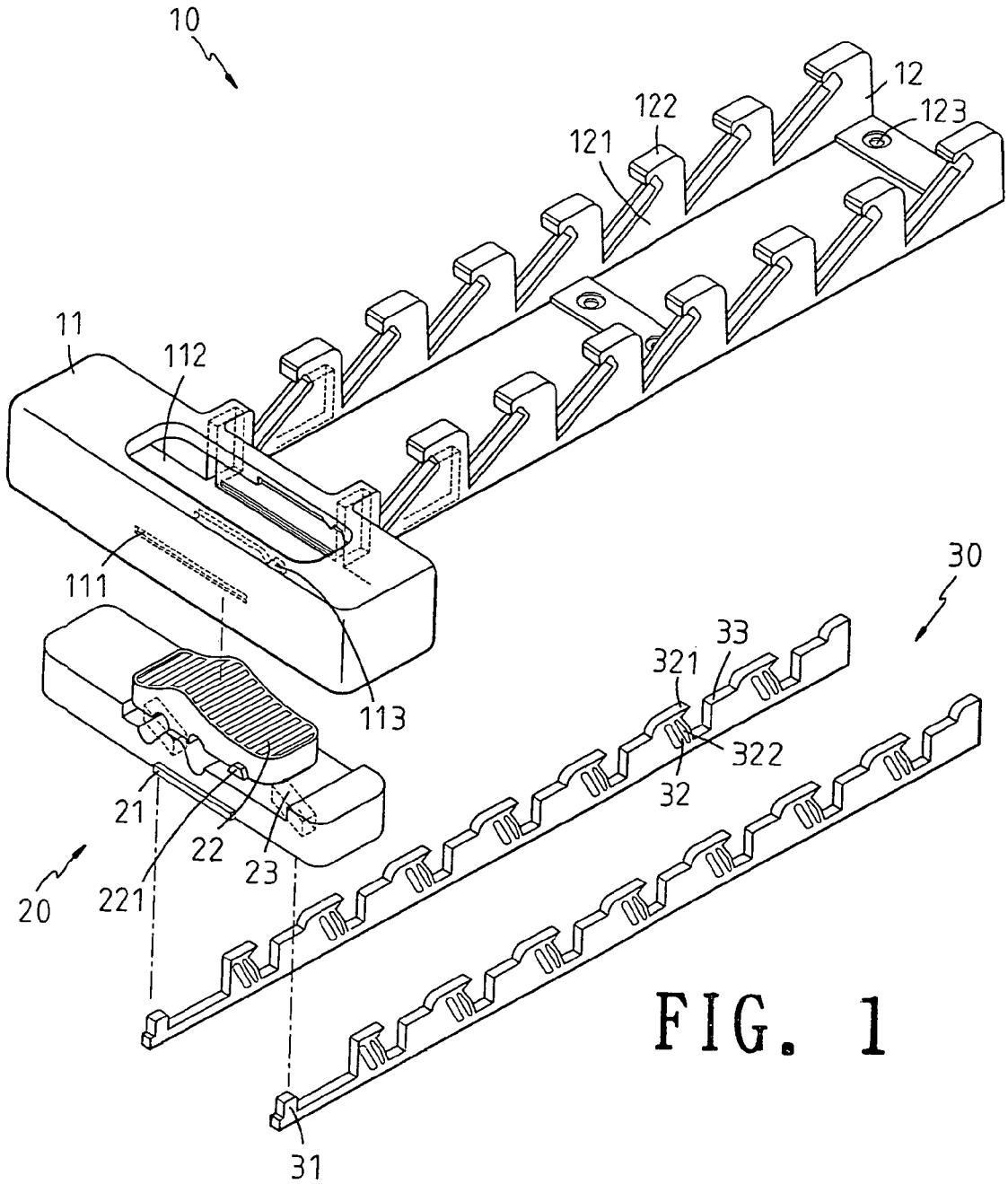
FIG. 1 is an exploded view to show the tool rack of the present invention.
Figure 2:
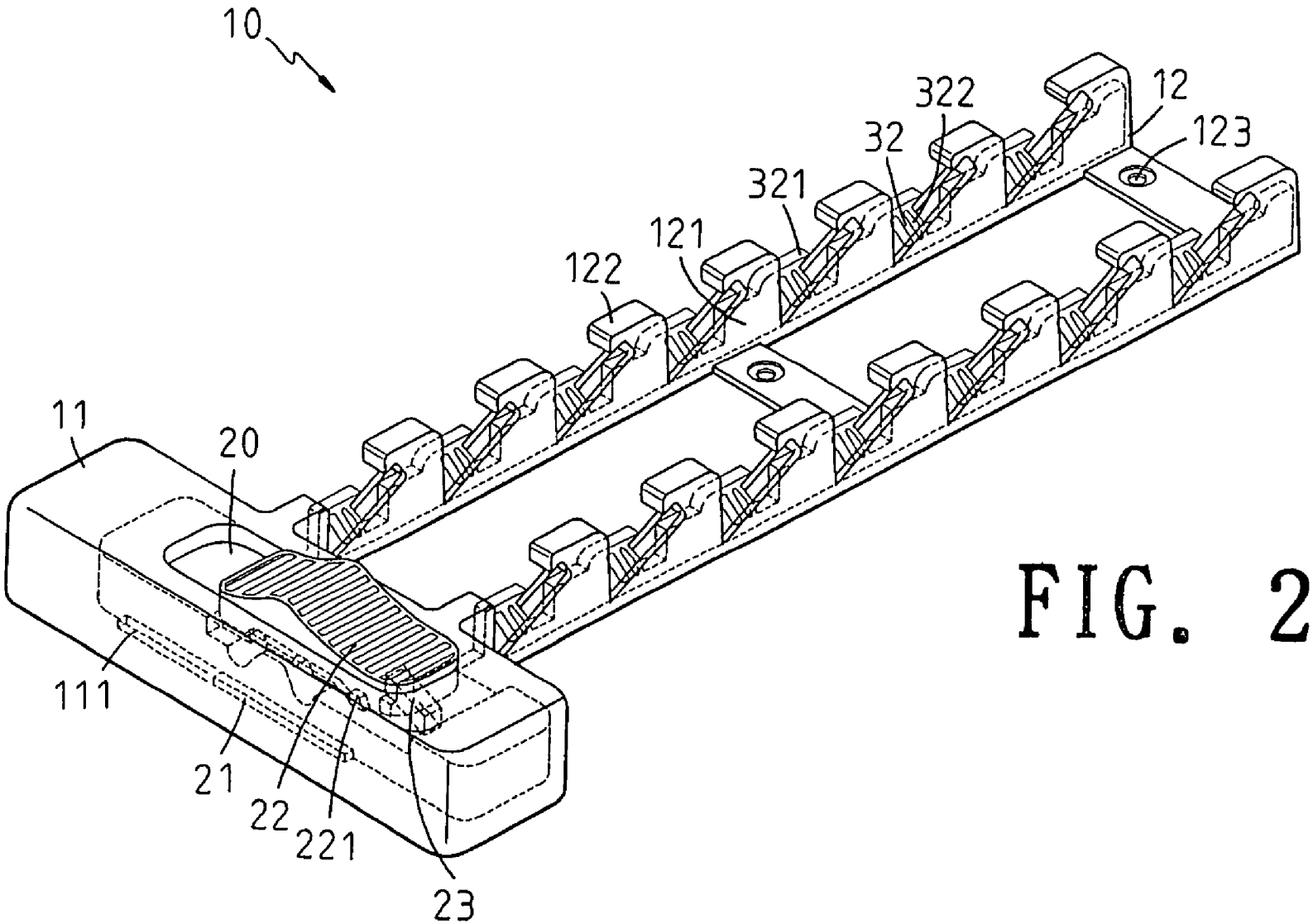
FIG. 2 is a perspective view to show that the locking device of the tool rack is in locked position.
Figure 3:
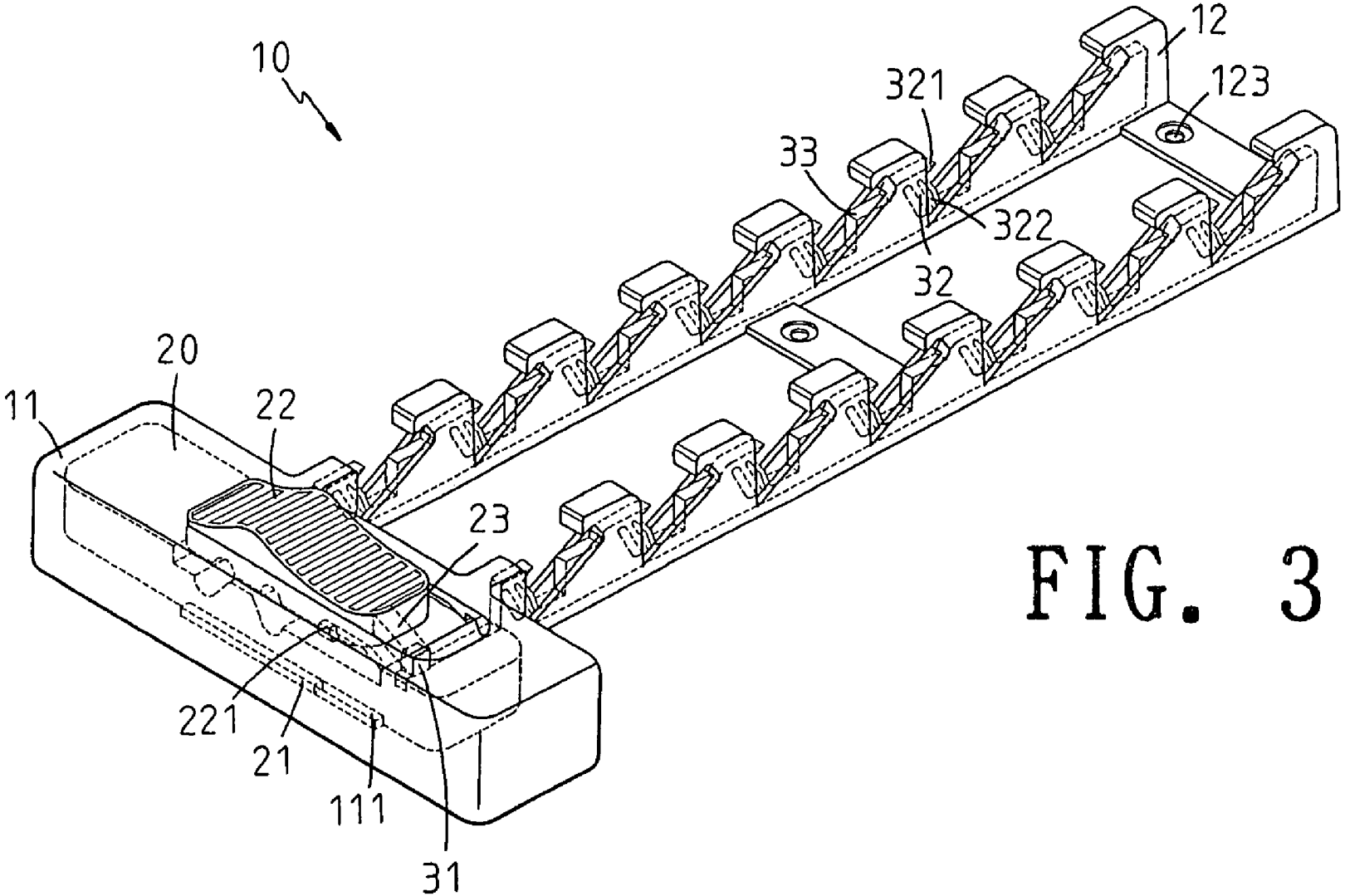
FIG. 3 is a perspective view to show that the locking device of the tool rack is in unlocked position.

Referring to FIGS. 1 and 2, the rack tool 10 of the present invention comprises two fixed members 12 and an end member 11 is connected to two respective ends of the fixed members 12. The end member 11 has a top hole 112 and a slot ill defined in a wall of the end member 11. A plurality of connection plates are connected between the two fixed members 12 and the connection plates each have a connection hole 123 so that multiple sets of the rack tools 10 can be connected with each other by bolts extending through the connection holes 123. Each fixed member 12 has an open boftom and a plurality of first protrusions 121 extending from a top thereof. Each first protrusion 21 has a first hook 122 on a top end thereof and an inclined top edge with two sidewalls are connected to the first hook 122, and the open top is defined between the two sidewalls.

Two movable members 30 are movably received in the fixed members 12 via the open bottoms of the two fixed members 12 respectively and each movable member 30 has a second protrusion 32 and a third protrusions 33 extending from a top thereof. Each of the second protrusions 32 has a second hook 321 which faces the first hook 122 corresponding thereto. Each of the second protrusions 32 has at least one through hole 322 so that the second protrusions 32 have a certain level of flexibility. A plurality of recesses are defined between the second protrusions 32 and the third protrusions 33. The second protrusions 32 and the third protrusions 33 are movably engaged with the open tops of the first protrusions 121.

A locking device 20 is movably connected to the end member 11 via an open bottom of the end member 11 and two inclined grooves 23 are defined in an underside thereof. Two blocks 31 are respectively connected to two respective ends of the two movable members 30 and movably engaged with the two inclined grooves 23. The two inclined grooves 23 are orientated such that an angle is clamped between an axis of each inclined groove 23 and a direction of movement of the locking device 20. Therefore, when the locking device 20 moves, the two movable members 30 moved linearly in the fixed members 12. The locking device 20 has a ridge 21 which is movably engaged with the slot 111 of the end member 11. A push member 22 is connected on a top of the locking device 20 and extends through the top hole 112. The push member 22 has a cantilever end which is flexible and bendable downwardly. The cantilever end has an engaging piece 221 which is removably engaged with a notch 113 defined in an inside of the wall having the slot 111.

Figure 4:
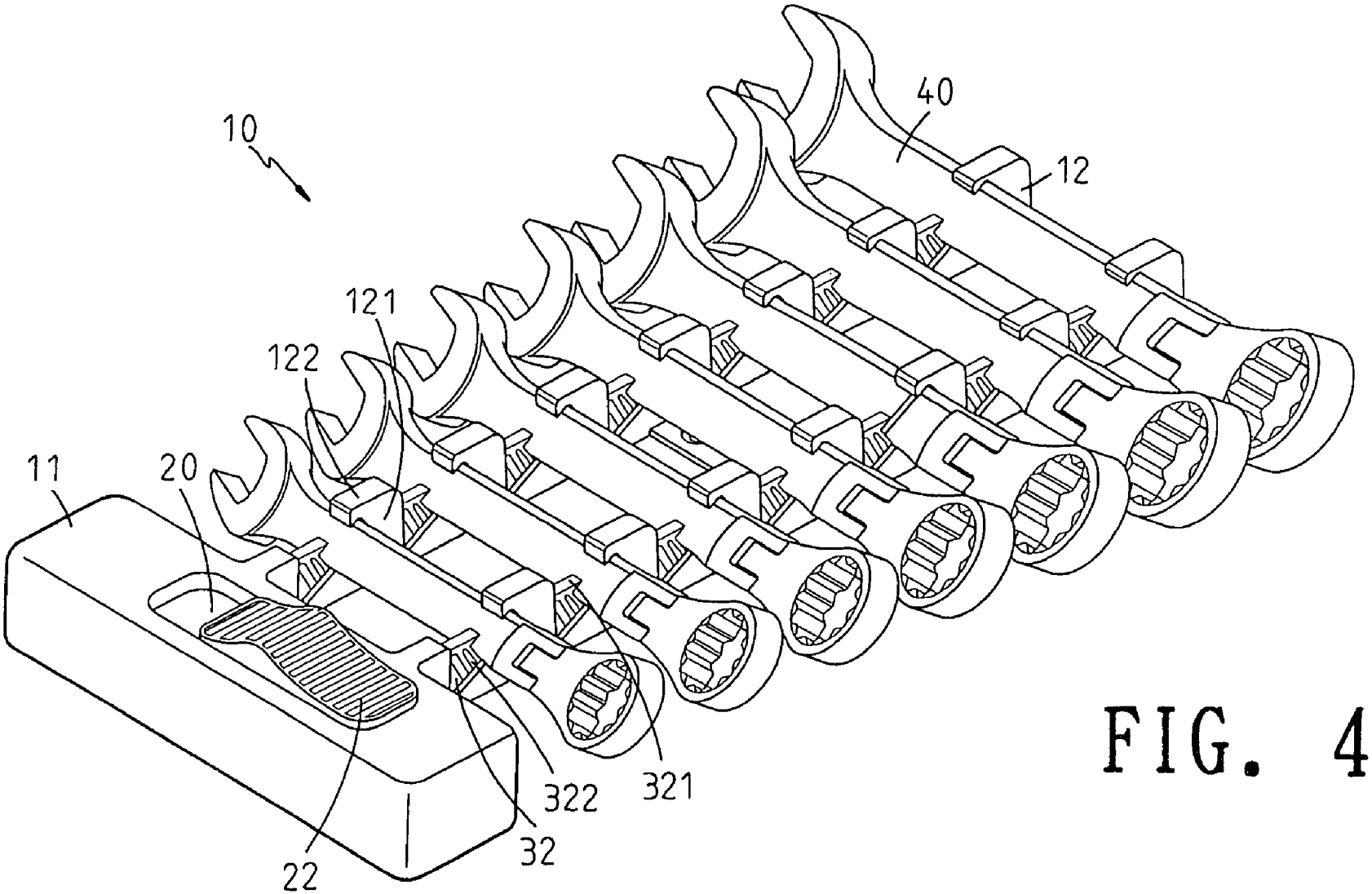
FIG. 4 is a perspective view to show that a plurality of wrenches are clamped by the fixed and movable members of the tool rack.
Figure 5:
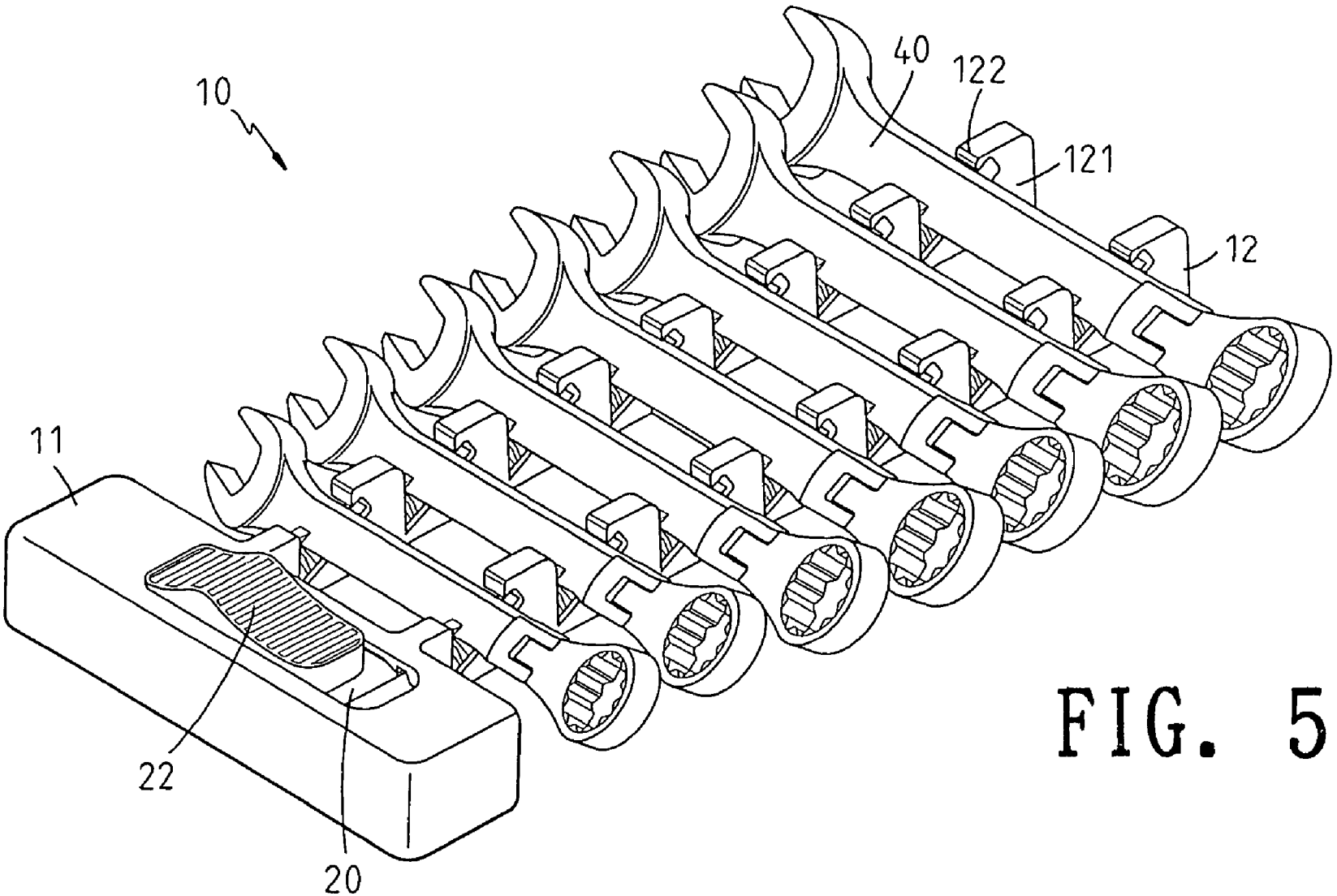
FIG. 5 shows that the locking device is shifted to unlock the tools.
Figure 6:
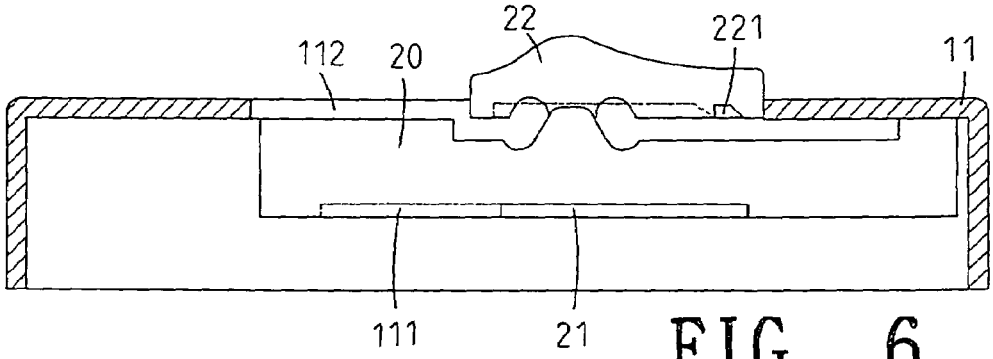
FIG. 6 is a cross sectional view to show that the engaging piece on the pushing member of the locking device is engaged with the notch of the end member.
Figure 7:
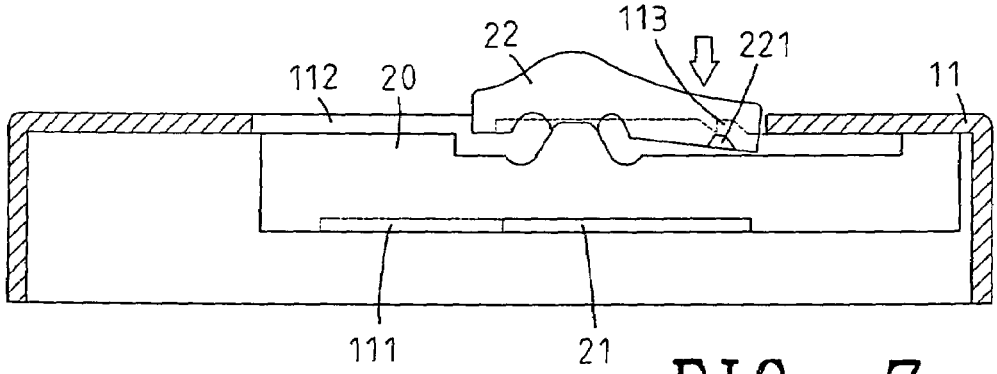
FIG. 7 is a cross sectional view to show that the engaging piece of the pushing member of the locking device is disengaged from the notch of the end member by pushing the cantilever end of the shift member downward.
Figure 8:
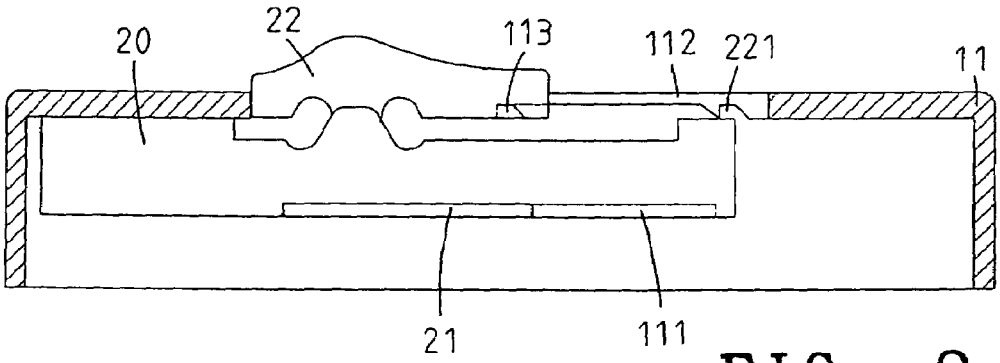
FIG. 8 is a cross sectional view to show that the push member is shifted to unlocked position.

As shown in FIGS. 4 and 6, the wrenches 40 are engaged with the recesses of the movable members 20 and located between the first and second protrusions 121, 32. The push member 22 is shifted to its locked position and the cantilever end of the push member 22 is pushed downwardly and the engaging piece 221 is engaged with the notch 113.to lock the push member 22. The third protrusions 33 are received between the two walls of the first protrusions 121 and the wrenches 40 are clamped between the first and second hooks 122, 321.

When picking the wrenches 40 up, as disclosed in FIGS. 3, 5, 7 and 8, the push member 22 is shifted to the unlocked position, and the cantilever end is first pushed downward to disengage the engaging piece 221 from the notch 113 and then moves the push member 22, the movement of the push member 22 forces the movable members 30 to move toward the end member 11, so that the third protrusions 33 are exposed from the inclined edges of the first protrusions 121 to push out the wrenches 40. The wrenches 40 are then easily to be picked up.

While we have shown and described the embodiment in accordance with the present invention, it should be clear to those skilled in the art that further embodiments may be made without departing from the scope of the present invention.

What is claimed is:

1. A tool rack comprising:

two fixed members and an end member connected to two respective ends of the fixed members, each fixed member having a plurality of first protrusions and each first protrusion having an open top, each of the first protrusions having a first hook extending from a top thereof;

a movable member movably received in each of the fixed members and each movable member having a second protrusion and a third protrusion extending from a top thereof, a plurality of recesses defined between the second protrusions and the third protrusions, the second protrusions and the third protrusions movably engaged with the open tops of the first protrusions, each of the second protrusions having a second hook which faces the first hook corresponding thereto, and a locking device movably connected to the end member and having two inclined grooves defined in an underside thereof, two blocks respectively connected to two respective ends of the two movable members and the two blocks movably engaged with the two inclined grooves, so that when the locking device moves, the two movable members moved in the fixed members.

2. The tool rack as claimed in claim 1, wherein each of the two fixed members has an open bottom and the two movable members are movably inserted into the fixed members via the open bottom.

3. The tool rack as claimed in claim 1, wherein each of the first protrusions has an inclined top edge with two sidewalls and the open top is defined between the two sidewalls.

4. The tool rack as claimed in claim 1, wherein each of the second protrusions has at least one through hole.

5. The tool rack as claimed in claim 1, wherein the end member has a top hole and a slot defined in a wall of the end member, the locking device is inserted into the end member from an open bottom of the end member and has a ridge which is movably engaged with the slot, a push member connected on a top of the locking device and extends through the top hole.

6. The tool rack as claimed in claim 5, wherein a notch is defined in an inside of the wall having the slot and the push member has a cantilever end which is flexible and bendable downwardly, the cantilever end has an engaging piece which is removably engaged with the notch.

7. The tool rack as claimed in claim 1, wherein a plurality of connection plates are connected between the two fixed members and the connection plates each have a connection hole.

* * * * *